US007234250B2

(12) United States Patent
Fogarty et al.

(10) Patent No.: US 7,234,250 B2
(45) Date of Patent: Jun. 26, 2007

(54) CONVERTIBLE TRACTION SHOES

(76) Inventors: Stacy Renee Fogarty, 13137 S. Foxridge Dr., Olathe, KS (US) 66062; Patrick Michael O'Brien, 1670 SW. Sunset Blvd., Portland, OR (US) 97239; John Michael O'Brien, 9385 SW. Iowa Dr., Tualatin, OR (US) 97062

( * ) Notice: Subject to any disclaimer, the term of this patent is extended or adjusted under 35 U.S.C. 154(b) by 79 days.

(21) Appl. No.: 11/053,590

(22) Filed: Feb. 7, 2005

(65) Prior Publication Data

US 2006/0174518 A1 Aug. 10, 2006

(51) Int. Cl.
*A43C 15/02* (2006.01)

(52) U.S. Cl. ..... 36/61

(58) Field of Classification Search ..... 36/61, 36/134

See application file for complete search history.

(56) References Cited

U.S. PATENT DOCUMENTS

| | | | | |
|---|---|---|---|---|
| 2,303,744 | A | 12/1942 | Jacobs | |
| 4,763,426 | A | 8/1988 | Polus et al. | |
| 4,821,434 | A * | 4/1989 | Chein | 36/134 |
| 4,873,774 | A | 10/1989 | Lafever | |
| 5,289,647 | A | 3/1994 | Mercer | |
| 5,299,369 | A | 4/1994 | Goldman | |
| 5,526,589 | A | 6/1996 | Jordan | |
| 5,732,482 | A | 3/1998 | Remington | |
| 5,737,855 | A | 4/1998 | Jordan | |
| 5,740,619 | A | 4/1998 | Broder | |
| 5,788,335 | A | 8/1998 | O'Brien | |
| 5,810,451 | A | 9/1998 | O'Brien | |
| 5,815,951 | A | 10/1998 | Jordan | |
| 5,946,828 | A | 9/1999 | Jordan | |
| 6,022,082 | A | 2/2000 | O'Brien | |
| 6,058,627 | A | 5/2000 | Violette | |
| 6,125,556 | A | 10/2000 | Peckler | |
| 6,244,666 | B1 | 6/2001 | O'Brien | |
| 6,256,907 | B1 | 7/2001 | Jordan | |
| 6,386,252 | B1 | 5/2002 | O'Brien | |
| 6,905,564 | B1 | 6/2005 | O'Brien et al. | |

FOREIGN PATENT DOCUMENTS

| | | |
|---|---|---|
| EP | 0 223 700 A1 | 11/1986 |

* cited by examiner

*Primary Examiner*—Ted Kavanaugh
(74) *Attorney, Agent, or Firm*—Schwabe, Williamson & Wyatt, P.C.

(57) ABSTRACT

A convertible shoe having a shoe body and a shoe sole. An air channel formed in said shoe sole including pressurized air inlet and air exhaust. An elongated pocket or multiple individual pockets in the bottom of the shoe sole and along said air channel. A flexible wall portion between said air channel and pocket that expands into the pocket(s) upon pressurization of said air channel. A protrusion affixed to said flexible wall portion and which extends out of said pocket and into engagement with a support surface when said air channel is pressurized.

7 Claims, 4 Drawing Sheets

CONVERTIBLE TRACTION SHOES

FIELD OF INVENTION

This invention relates to a shoe that is provided with traction enhancing elements that can be extended and retracted to adapt the shoe to different support surfaces.

BACKGROUND OF INVENTION

Traction devices as contemplated for the present invention are often referred to generically as cleats. A cleated football shoe has different types of cleats that provide improved traction on different kinds of turf. A golf shoe has cleats that provide stability for a golfer when swinging a golf club. Not as common but considered to be as desirable are cleated shoes for walking on ice-laden walks and so on.

The problem with such cleated shoes is that the cleats are not desirable on surfaces that either are impenetrable to the cleats or have surface finishes that can be damaged by the cleats (e.g., inside floors of homes, restaurants, club houses and the like).

This dilemma has not gone unnoticed and there are numerous patents that have issued that purport to solve the problem via retractable cleats. Typically, holes are provided in the sole and/or heel of the shoe and different means enable the extension and retraction of cleats through the holes.

Whereas these concepts have been in existence for years, none are considered feasible and none have found acceptability in the marketplace. It is accordingly an object of the present invention to provide a shoe having the retractable cleats that adds the desired feasibility.

BRIEF DESCRIPTION OF THE INVENTION

The present invention provides novelty and feasibility in the manner of constructing the shoe bottom. Between an inner and outer layer (of a shoe sole or shoe heel) there is a continuous enclosed channel. The channel is designed to receive pressurized air. Overlying the channel at the outer layer is a sequence or pattern of cleats that may be integral with the material of the outer layer. When air is extracted from the channel, i.e., not pressurized, the resilience provided to the material causes the material of the outer layer to retract into the channel and in doing so, retracts the cleats so as to not engage a support surface supporting a person wearing the shoe. When the channel is pressurized, the channel expands to force the resiliently retracted material including the cleats into engagement with the supporting surface.

Providing the pressurized air to the channel and then release of the air from the channel can be accomplished in various ways as will be explained in the following detailed description having reference to the accompanying drawings.

DESCRIPTION OF A PREFERRED EMBODIMENT

Figure 1:
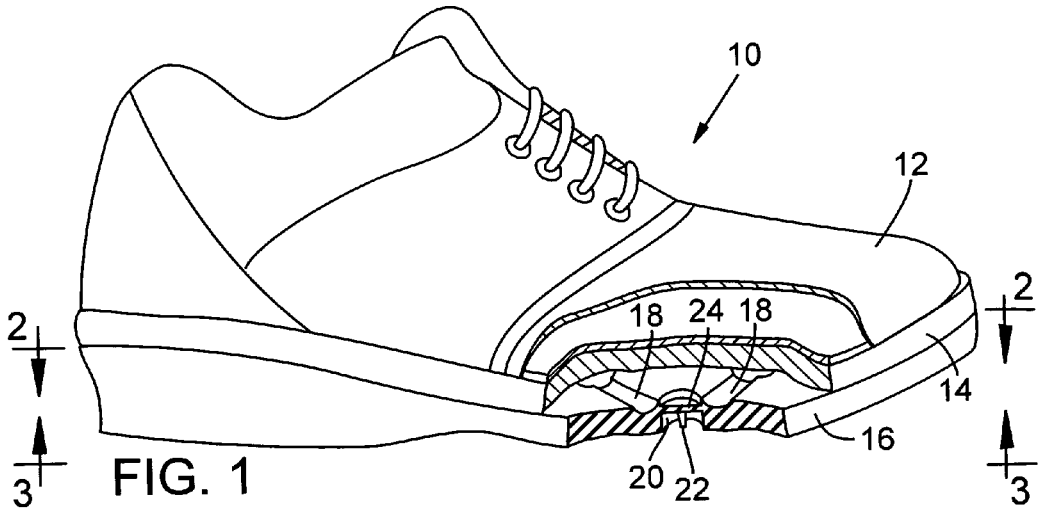
FIG. 1 is a partially sectional side view of a cleated shoe in accordance with the present invention.

Reference is made to FIGS. 1–4 which illustrate a preferred embodiment of the invention. In FIG. 1 is shown a shoe having an upper body portion 10. The upper body portion can take any of a wide variety of forms but typically such a shoe would be of the type worn for sporting events such as golf, football, soccer and the like, i.e., sports played on turf, or of the type worn for outdoor and indoor use and in particularly in northern communities where outdoor use can involve walking or running on ice.

The upper body portion 10 will typically have a foot wrap 12 for the sides and upper foot and an upper sole portion 14 of semi-flexible/semi-stiff leather or molded rubber that is shaped to the contour of a wearer's foot bottom.

Figure 2:
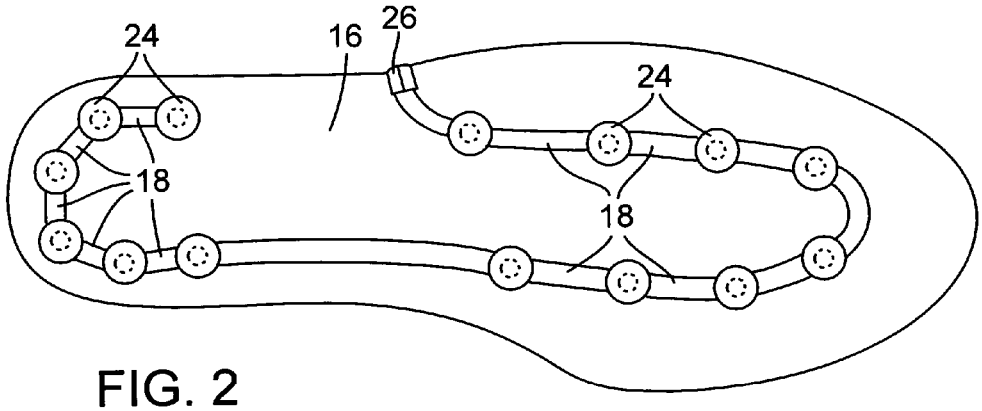
FIG. 2 is a view of a sole portion of the shoe of FIG. 1 as seen from view lines 2-2 of FIG. 1.
Figure 3:
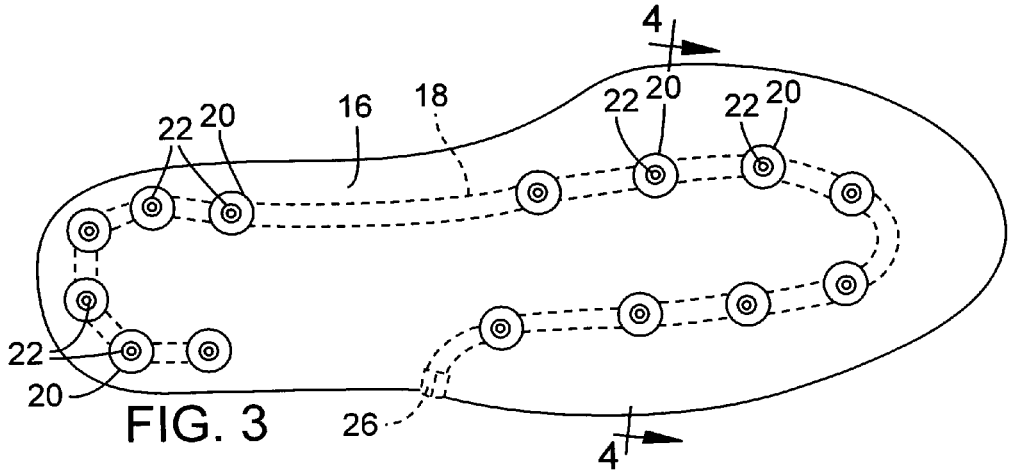
FIG. 3 is a view of the sole portion of FIG. 2 taken on view lines 3-3 of FIG. 1.

The portion of the shoe in which the features of the present invention are incorporated is the lower sole portion 16. As shown in FIGS. 1 and 2, the lower sole portion 16 is provided with a groove or channel 18 that substantially circumscribes the foot bottom. At spaced locations along the channel 18 there is provided a sequence of strategically placed pockets 20. (See also FIG. 4A.) Affixed to the apex of the pocket, as particularly seen in FIGS. 4A and 4B, is a protrusion 22 which can be of the same material as the sole portion 16, e.g., a hard rubber protrusion, or of a different material, e.g., a metal spike or cleat protrusion securely affixed to the sole portion 16.

Figure 4A:
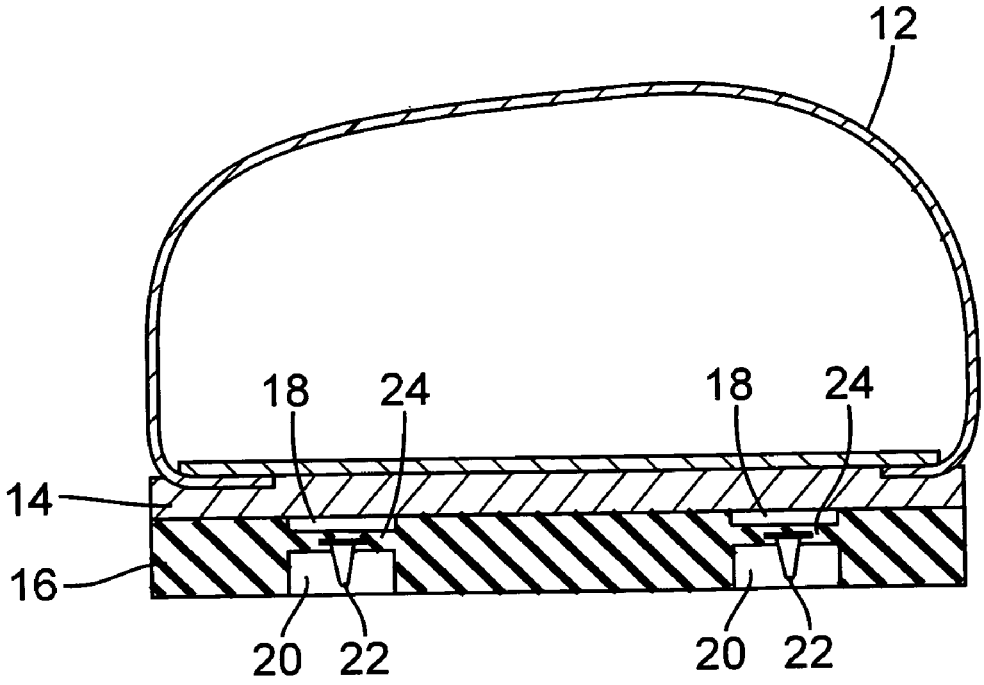
FIGS. 4A and 4B are retracted and expanded views respectively of the sole portion of FIGS. 2 and 3 as seen from view lines 4-4 of FIG. 3.

It will be observed that the pockets 20 effectively provide hinge portions 24 that are designed to resiliently withdraw the protrusions 22 into the pockets 20 as viewed in FIG. 4A.

Returning to FIGS. 1 and 2, it will be appreciated that upper and lower sole portions are intended to be securely bonded together, except not in the area defined by the channel 18. Also provided in the bottom sole portion 16 is an inlet/outlet valve 26. It is shown at an intermediate position, i.e., between the toe and heel of the shoe, but the location is primarily one of personal choice. Inlet/outlet valve 26 enables the introduction of pressurized air into the channel 18 and the release of the air from the channel 18.

Figure 4B:
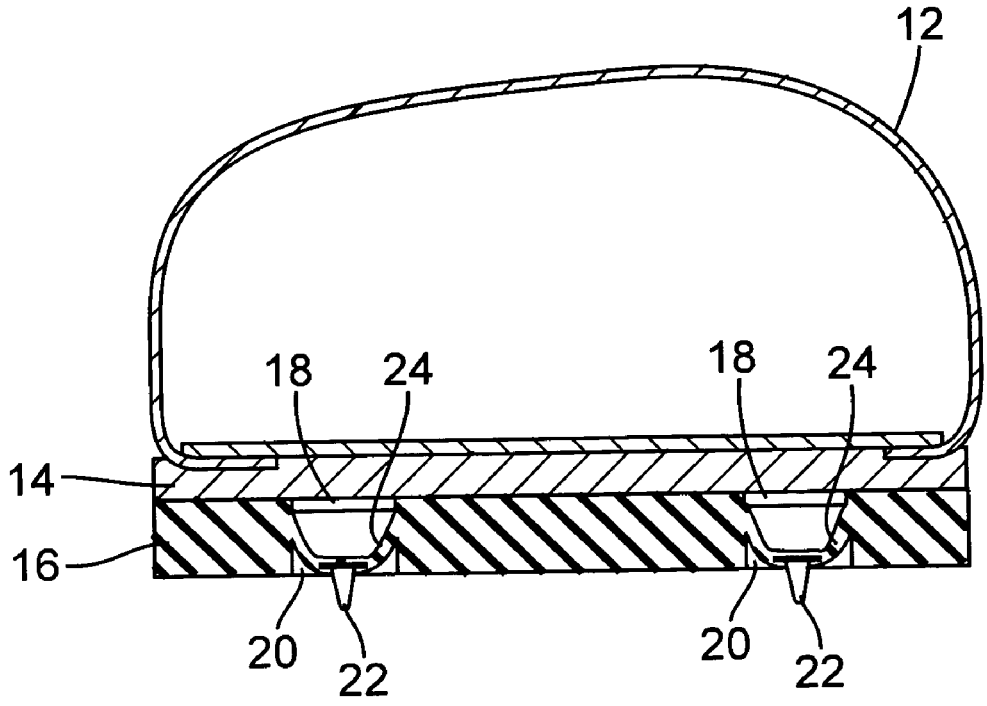
Figure 5A:
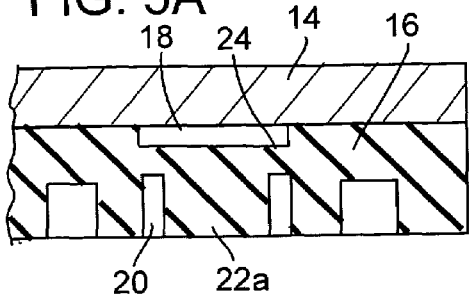
FIGS. 5A to 5H illustrate variations of expandable cleats for the cleated shoe.
Figure 5B:
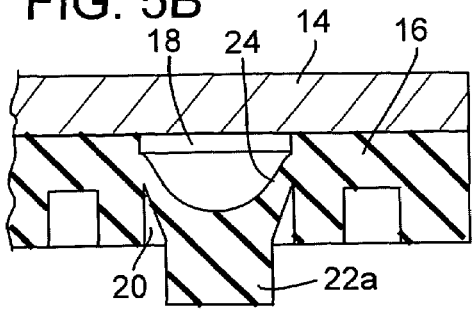
Figure 5C:
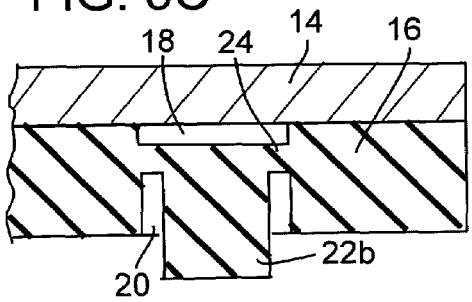
Figure 5D:
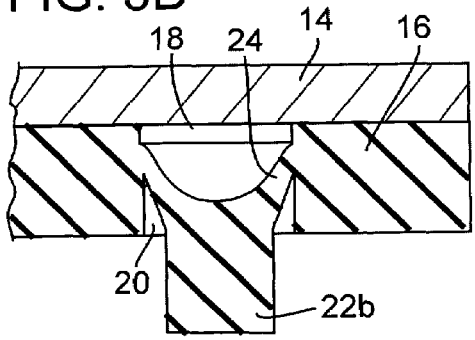
Figure 5E:
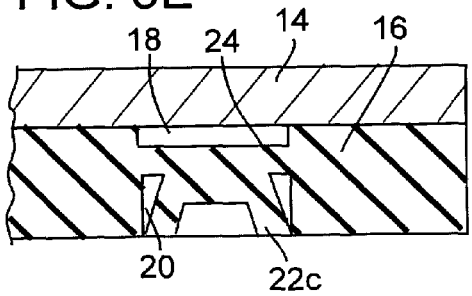
Figure 5F:
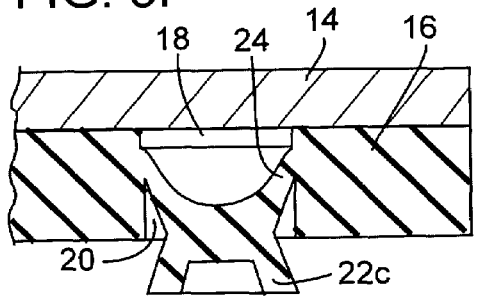
Figure 5G:
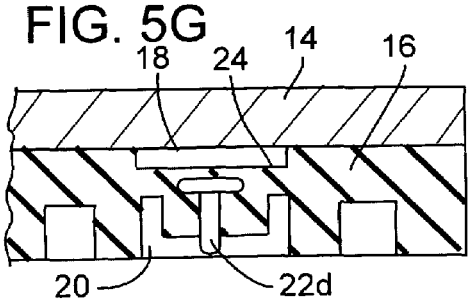
Figure 5H:
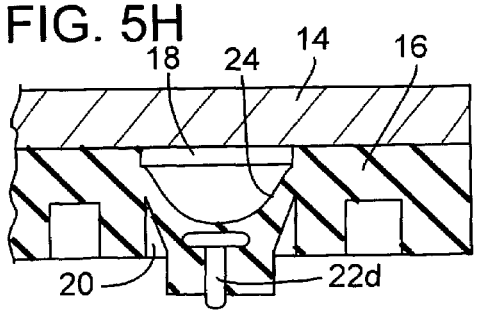

With the channel 18 pressurized, the resiliency of the hinge portion 24 is overcome and the pockets 20 are reconfigured to force the protrusions 22 from the retracted position of FIG. 4A to the extended position of FIG. 4B.

The reader will appreciate that the shoe having the protrusions withdrawn as seen in FIG. 4A can be worn to walk on hard surfaces, e.g. typically used for indoor flooring. When the shoe is to be used, e.g., on icy sidewalks or for sports play on a turf and the like, the user can simply introduce air pressure, e.g. from a bicycle pump, CO2 container or any of a number of other air pressure sources which will cause the protrusions 22 to be extended as viewed in FIG. 4B and thereby enhance traction.

Figure 6:
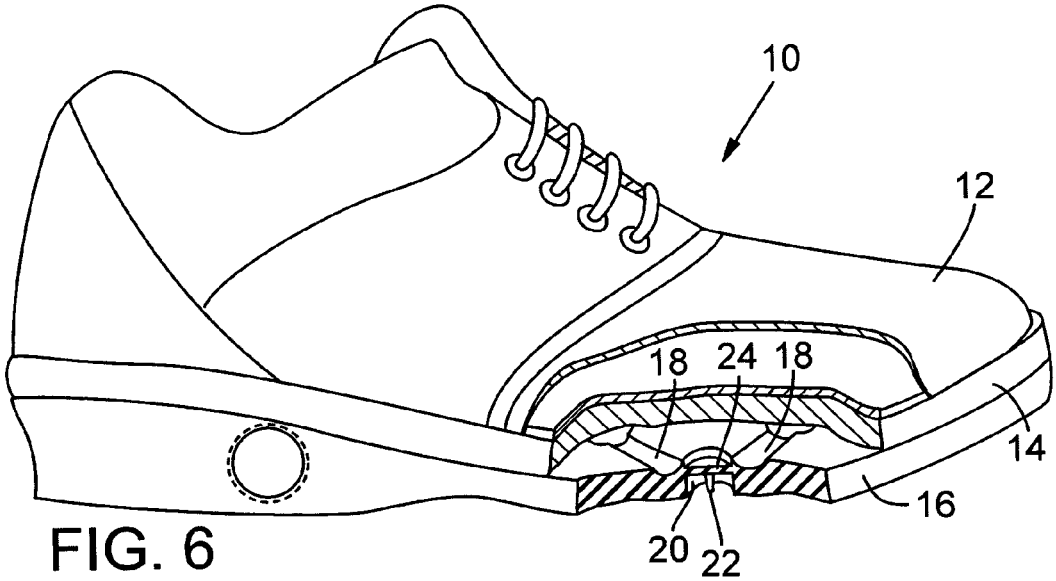
FIGS. 6–8 are views similar to FIGS. 1–3 showing an alternate air pressure source.
Figure 7:
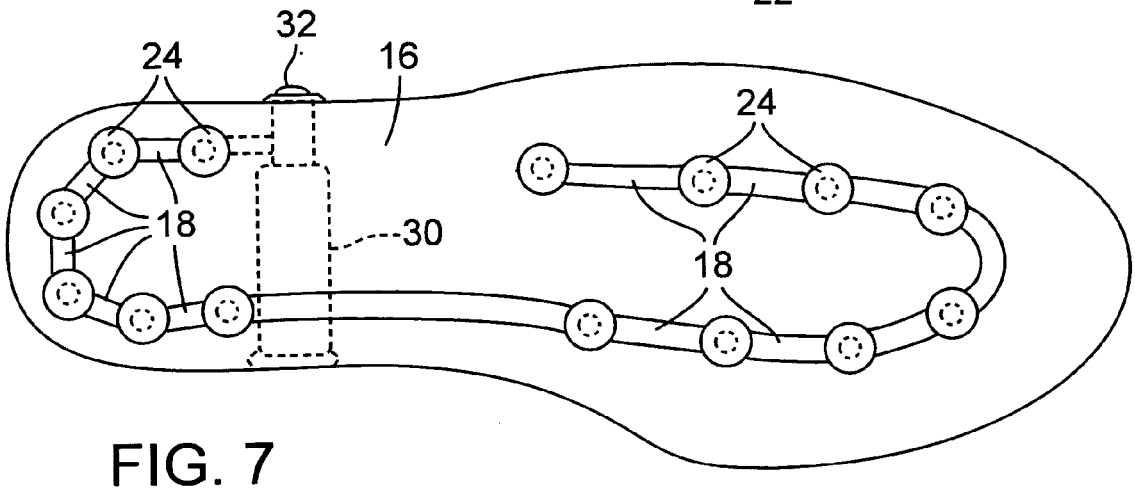
Figure 8:
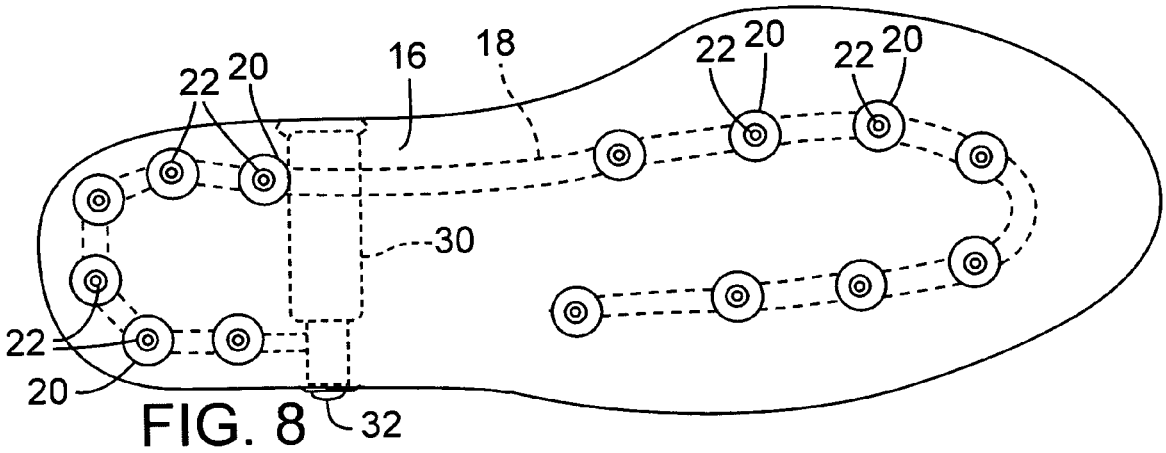

Whereas the illustrated embodiment utilizes an air channel, pockets, protrusions and an exterior air pressure source, there are many variations that will readily occur to those skilled in the art. Reference is made to FIGS. 5A to 5H which illustrate variations in the configuration of the protrusions 22, i.e., 22*a*–22*d* shown in retracted and extended conditions. The valve 26 can be designed to accept a tire pump valve, and the valve may be provided with a valve stem which can be pressed inwardly to release the air pressure, e.g. in the same manner as a bicycle. A small hand pump or replaceable CO2 cartridge may be embedded in the heel portion of the bottom sole, e.g. see FIGS. 6–8. A CO2 cartridge 30 is provided with a three-way valve 32 that can be actuated by hand to insert and release air into and from the channel 18.

Still further, the channel 18 may be incorporated into the upper sole portion or the entire combination of upper and lower sole portion may be molded as a single layer with air channel 18, e.g. in the form of a collapsible tube embedded in the mold.

Still further, the protrusion 22 can be a single rib that extends the length of the channel and extends from a continuous elongated pocket formed in the bottom surface of the bottom sole portion.

At least one aspect of the present invention is considered to be the provision of a continuous air channel overlying a sequence of pockets or a continuous linear pocket separated from the more rigid sole portion 16 by a flexible resilient hinge, and a protrusion or protrusions carried by the hinge (s). The hinge inherently draws the protrusions into the pocket in a non-pressurized state and the protrusions are extended from the shoe bottom with the channel pressurized.

In consideration of the above disclosure and statements, the claims appended hereto are intended to be interpreted in a broad sense with the terms used in the claims broadly interpreted in accordance with the meanings as commonly used in the trade.

The invention claimed is:

1. A convertible shoe for enhancing traction comprising:

a shoe body and a shoe sole, said shoe sole having an inner surface and a bottom surface, the bottom surface adapted for engaging a support surface;

an air channel formed in said shoe sole and a designated pocket underlying said air channel and defining a flexible wall portion between said air channel and said pocket, and a protrusion coupled to and extended from said flexible wall portion and residing in said pocket;

an air source connection to said air channel for introducing and releasing pressurized air to and from said channel, said flexible wall portion responsive to said pressurized air to extend the flexible wall portion into said pocket and to thereby extend said protrusion out of said pocket and into engagement with said support surface, and wherein upon removal of said air, resiliency of the flexible wall portion urges retraction of said protrusion.

2. A convertible shoe as defined in claim 1 wherein said pocket extends along a substantial length of said air channel, and said flexible wall and said protrusion are substantially co-extensive with said pocket.

3. A convertible shoe as defined in claim 2 wherein said protrusion is an integral part of said flexible wall.

4. A convertible shoe as defined in claim 1 wherein multiple pockets having multiple flexible wall portions are strategically positioned along the length of said air channel, and multiple protrusions accordingly projected from multiple ones of said multiple pockets.

5. A convertible shoe as defined in claim 1 wherein said connection includes an air inlet and an air outlet, said air outlet providing selective exhaustion of air pressure from said air channel.

6. A convertible shoe as defined in claim 5 wherein said air source is an exterior air source.

7. A convertible shoe as defined in claim 5 wherein said shoe sole includes a heel portion in a pressurized canister housed in said heel portion providing said air pressure source to said air channel.

* * * * *